US007785136B2

(12) United States Patent
Zhang et al.

(10) Patent No.: US 7,785,136 B2
(45) Date of Patent: Aug. 31, 2010

(54) POWER CONNECTOR AND A METHOD OF ASSEMBLING THE POWER CONNECTOR

(75) Inventors: De-Gang Zhang, Kunshan (CN); Ping-Sheng Su, Tu-Cheng (TW); Shu-Qiang Zhao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/506,474

(22) Filed: Jul. 21, 2009

(65) Prior Publication Data

US 2010/0015842 A1 Jan. 21, 2010

(30) Foreign Application Priority Data

Jul. 21, 2008 (CN) ..... 2008 1 0021385

(51) Int. Cl.
*H01R 3/00* (2006.01)

(52) U.S. Cl. ..... 439/490

(58) Field of Classification Search ..... 362/95, 362/114, 190; 439/490

See application file for complete search history.

(56) References Cited

U.S. PATENT DOCUMENTS

| | | | | |
|---|---|---|---|---|
| 6,572,402 | B2 | 6/2003 | Lin | |
| 7,168,975 | B2 * | 1/2007 | Kuo | 439/490 |
| 7,607,937 | B1 * | 10/2009 | Chang | 439/490 |
| 7,614,905 | B2 * | 11/2009 | Shen et al. | 439/490 |
| 7,677,916 | B2 * | 3/2010 | Chang | 439/490 |
| 2010/0022118 | A1 * | 1/2010 | Zhang et al. | 439/490 |

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

A power connector (100) has a mating plug (10) having an internal printed circuit board (15) and a light-emitting component (151) mounted to the internal printed circuit board, a cable (30) connecting with the internal printed circuit board and provided with a connecting section (34), a guiding pipe (50) enclosing the connecting section of the cable to transmitting the light from the light-emitting component, and a tube (35) made from insulative material and enclosing the cable by injection molding. The guiding pipe has a recess (51) defined thereon to receive a block member (90) to prevent the insulative material from reaching the internal printed circuit board when the tube is injection molded over the cable.

13 Claims, 6 Drawing Sheets

POWER CONNECTOR AND A METHOD OF ASSEMBLING THE POWER CONNECTOR

BACKGROUND OF THE INVENTION

1. Field of the Invention

The present invention relates generally to a power connector, and more particularly to a power connector with a guiding pipe for transmitting a light from the Light Emitting Diode (LED).

2. Description of the Prior Art

Direct current (DC) power connector has been widely used in electrical device to be connected to DC power plug to transmit direct current power. For showing whether the two connectors are connected to each other all right, an LED is assembled to the DC power connector. An U.S. Pat. No. 6,572,402, issued on Jun. 3, 2003 to Lin, discloses a DC Power plug having a mating plug for electrically connecting with a complementary connector. The mating plug has an internal printed circuit board and a light-emitting component mounted to the internal printed circuit board for indicating working status of the power connector. The DC power plug has a plurality of cables enclosing by a tube for connecting to internal printed circuit board of the mating plug, an internal barrel enclosing the mating plug and the cables by an engagement of the internal barrel and the mating plug, and a guiding pipe encircling the barrel. The DC power plug further has an outer shield to hold the guiding pipe and the cables together.

However, the power connector described above would result in a greatly complicated process and a high cost during the assembly of internal barrel to enclose mating plug and the cables.

Hence, in this art, an improved power connector to overcome the above-mentioned disadvantages of the prior art should be provided.

BRIEF SUMMARY OF THE INVENTION

A primary object, therefore, of the present invention is to provide with a power connector with LED and a simple produce process.

In order to implement the above object, a power connector matable with a complementary connector comprises a mating plug having an internal printed circuit board and a light-emitting component mounted to the internal printed circuit board for indicating working status of the power connector, a cable connecting with the internal printed circuit board of the mating plug and provided with a connecting section, a guiding pipe enclosing the connecting section of the cable to transmit the light from the light-emitting component, and a tube made from insulative material and enclosing the cable by injection molding. The guiding pipe has a recess defined thereon to receive a block member to prevent the insulative material from reaching the internal printed circuit board when the tube injection molding over the guiding pipe and the cable.

It is easy to assemble the power connector because an internal tube is provided to enclose the guiding pipe and the connecting section of the cable by injection molding. The recess of the guiding pipe receiving a block member could prevent insulative material from reaching the internal printed circuit board when the tube is molded over the guiding pipe and the cable. The block member provides with a protection of the internal printed circuit board and the lighting-emitting component.

Other objects, advantages and novel features of the invention will become more apparent from the following detailed description of a preferred embodiment when taken in conjunction with the accompanying drawings.

DETAILED DESCRIPTION OF THE INVENTION

Figure 1:
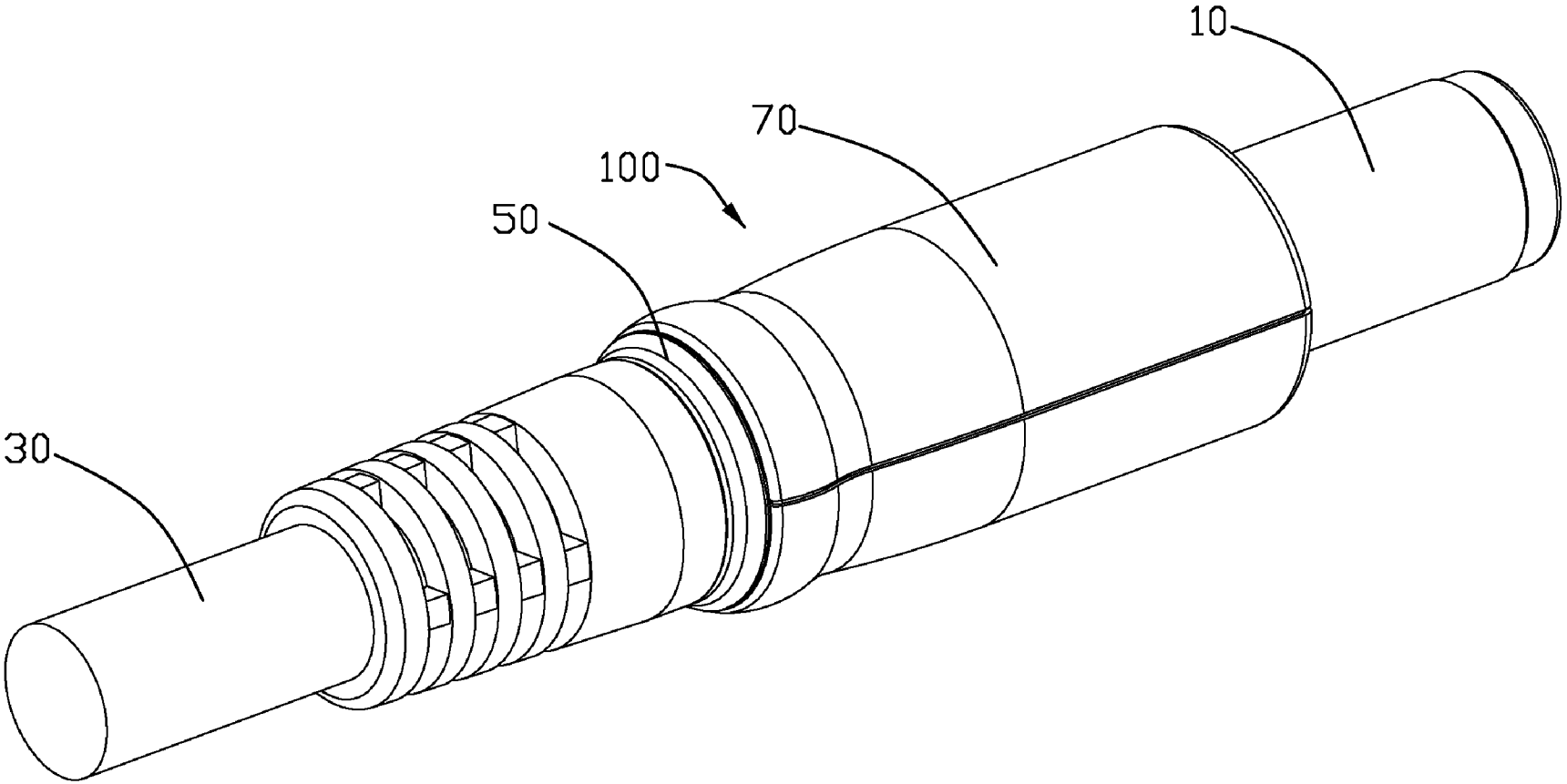
FIG. 1 is a perspective view illustrating a power connector in accordance with a preferred embodiment of the present invention.
Figure 2:
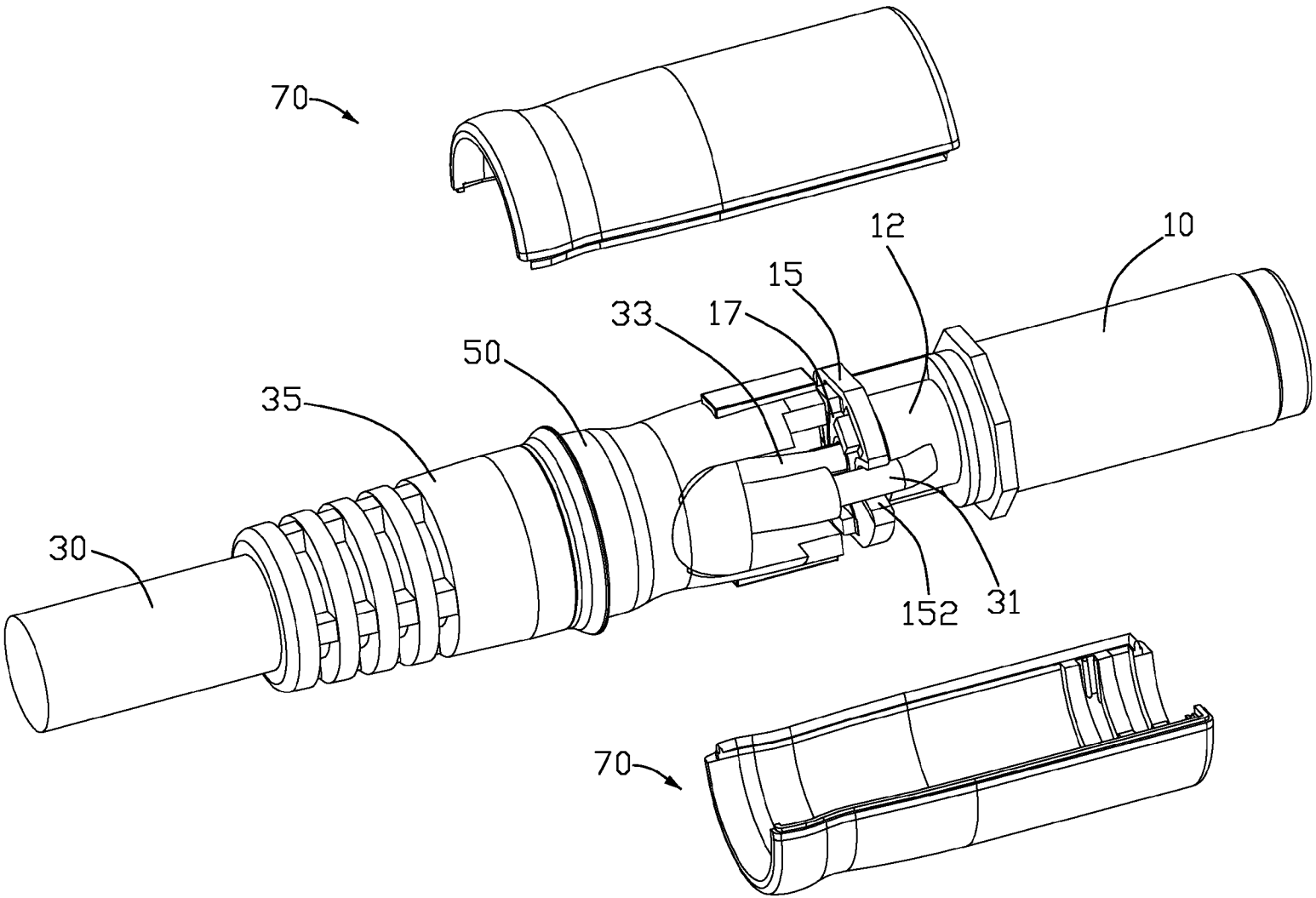
FIG. 2 is a perspective view of an outer barrel, cable connecting to a mating plug, a guiding pipe enclosing the cable, and a tube molding over the cable.
Figure 3:
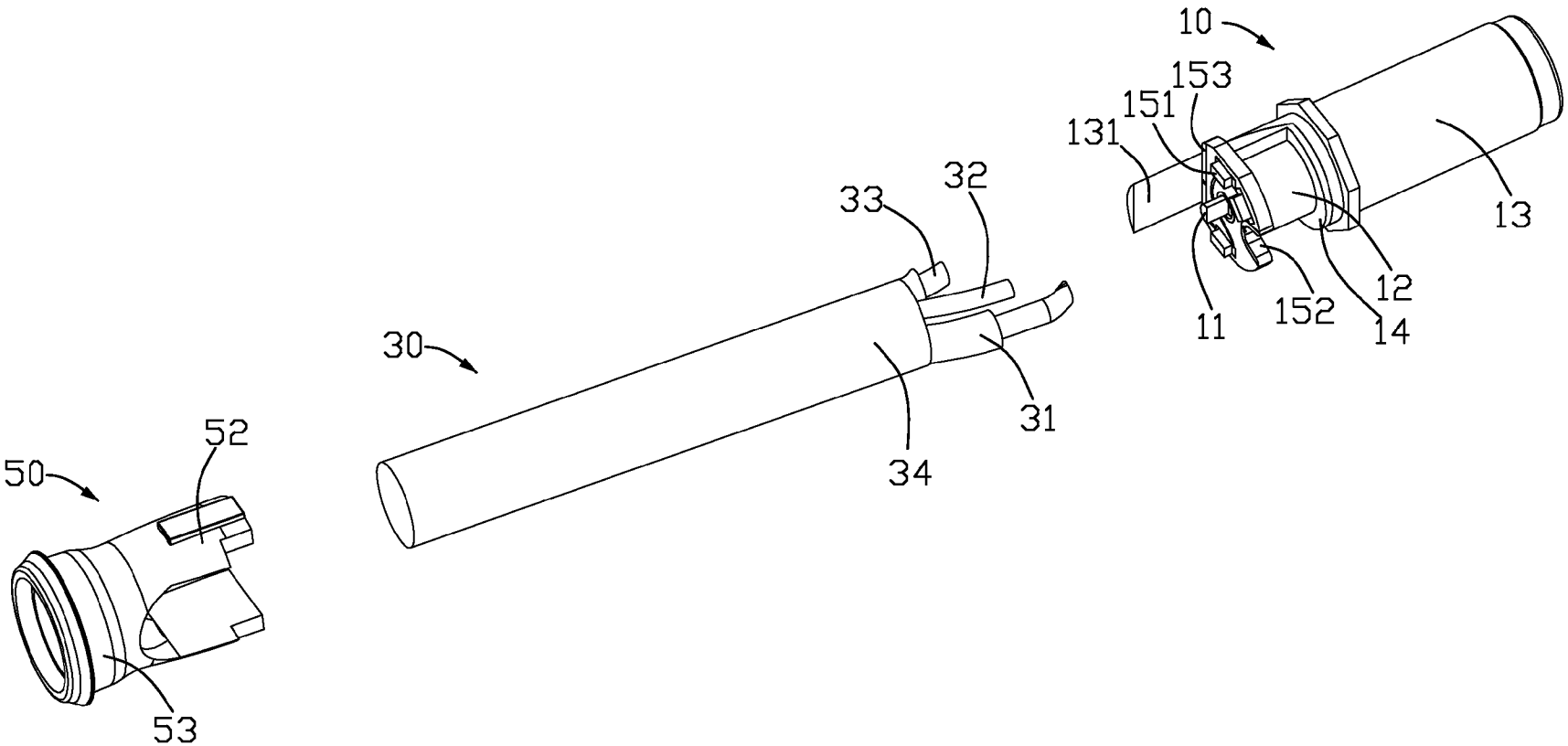
FIG. 3 is a partially exploded perspective view of the mating plug, the guiding pipe and the cable as shown in FIG. 2.
Figure 4:
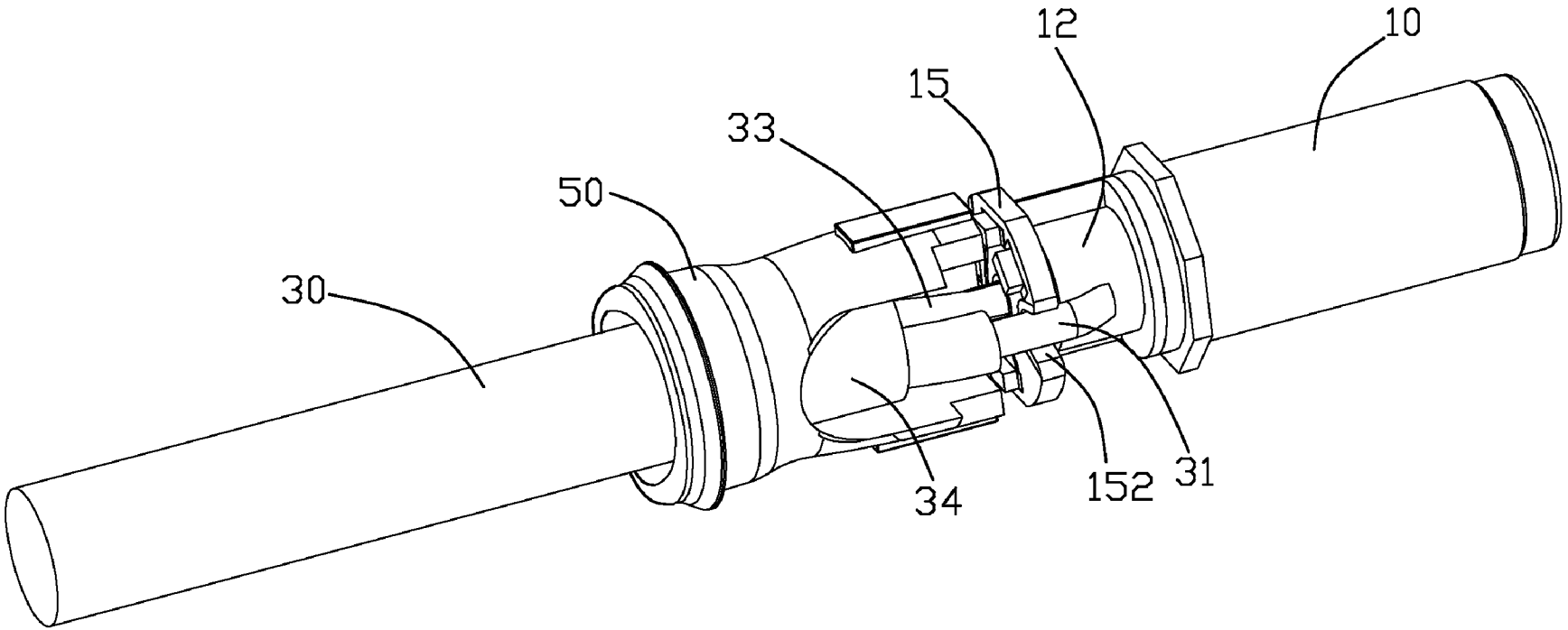
FIG. 4 is an assembled perspective view of the mating plug, the guiding pipe and the cable as shown in FIG. 3.

Reference will now be made in detail to a preferred embodiment of the present invention.

Referring to FIGS. 1-4, a power connector in accordance with a preferred embodiment of the present invention is shown. The DC power connector 100 matable with a complementary connector (not shown) comprises a mating plug 10, a cable 30 having a connecting section 34 disposed a front portion thereof, a guiding pipe 50 and an outer barrel 70 partially enclosing the mating plug 10.

The mating plug 10 has an internal printed circuit board 15 and a pair of light-emitting components 151 mounted to the internal printed circuit board 15 for indicating working status of the power connector 100. The internal printed circuit board 15 has an opening 152 defined on an edge portion thereof. The mating plug 10 has a central pin 11 embedded therein for grounding, an insulator 14 enclosing the central pin 11, a terminal 12 retained into the insulator 14 for transmitting anode power, and an outer conductor 13 enclosing the insulator 14 for transmitting cathode power. The insulator 14 located between the outer conductor 13 and the terminal 12. The outer conductor 13 has a protruding end 131 extending forwardly. The cable 30 has a first leg 31 extending through the opening 152 of the internal printed circuit board 15 to electrically connect with the terminal 12 of the mating plug 10 to connect with a cathode signal, a second leg 32 electrically connected to a protruding end 131 extending from the outer conductor 13 to connect with an anode signal, and a third leg 33 connected to the central pin 11 for grounding purpose.

Figure 5:
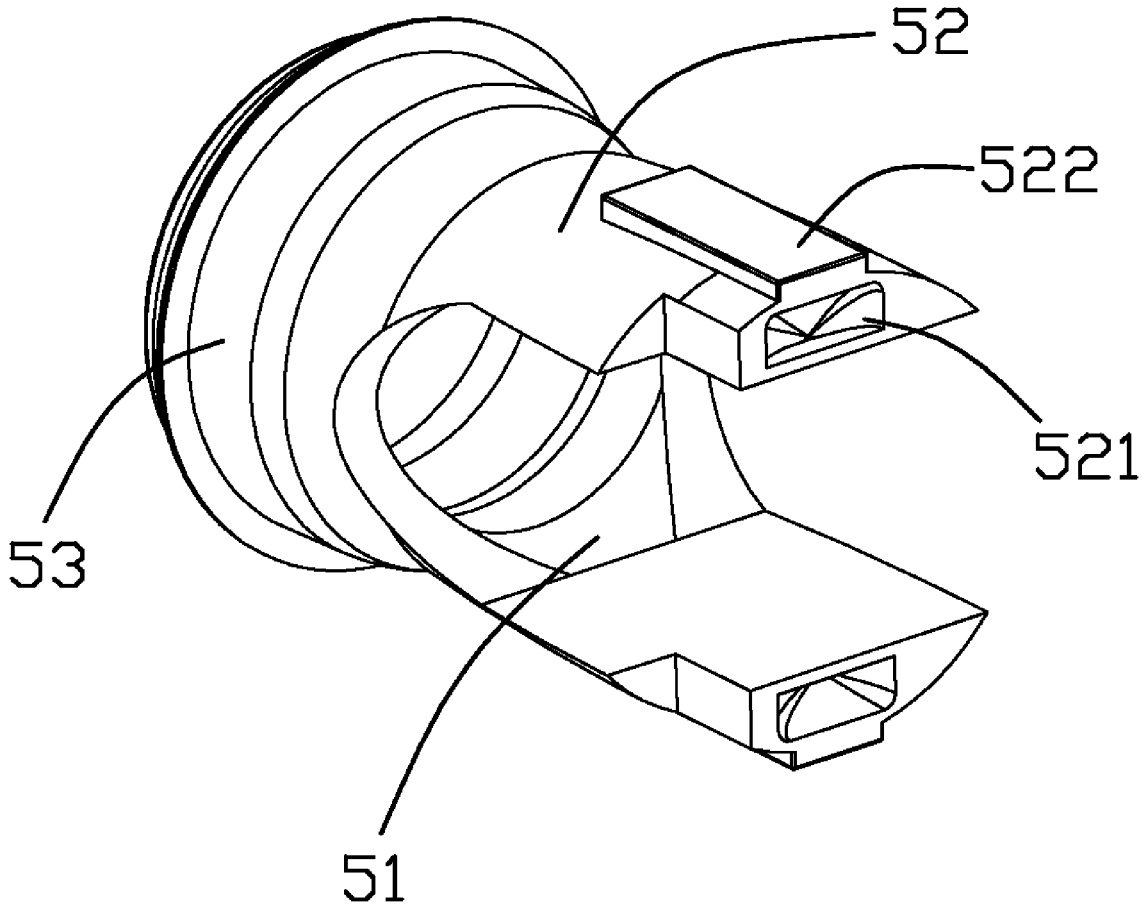
FIG. 5 is a perspective view of a guiding pipe.
Figure 6:
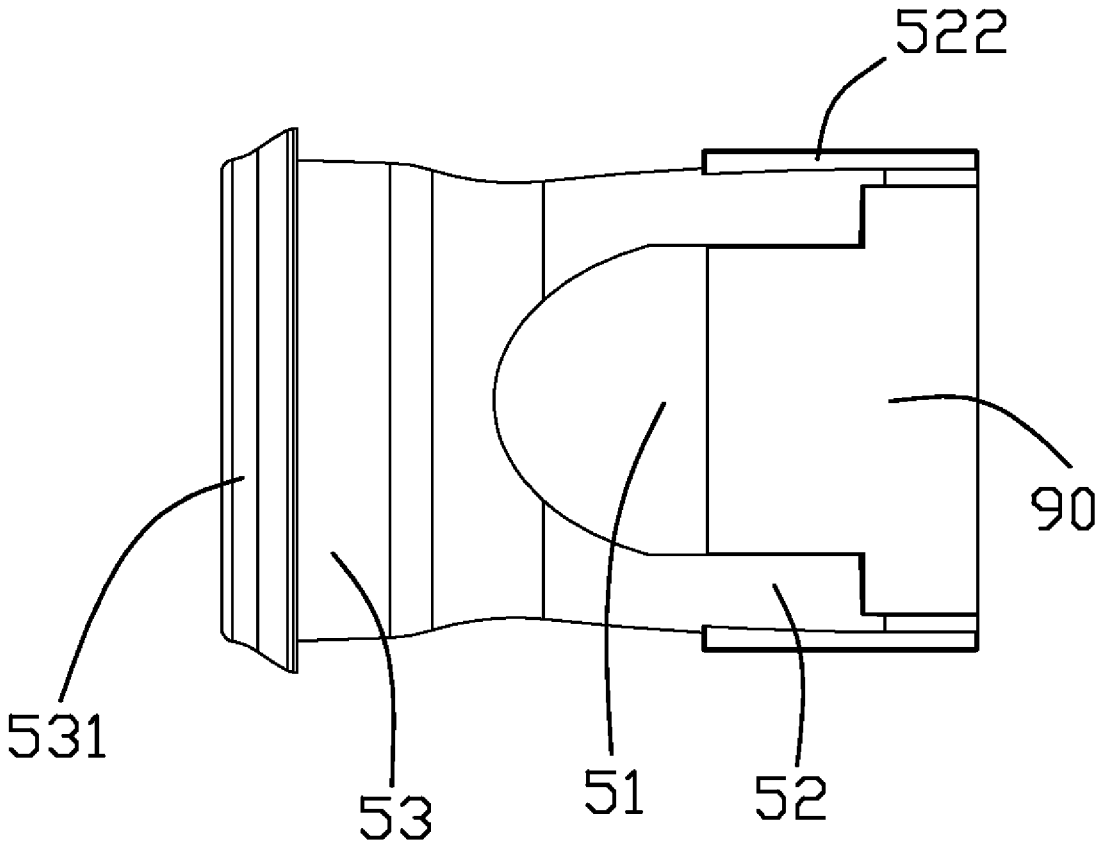
FIG. 6 is a perspective view of a guiding pipe and a block member mounted to a recess of the guiding pipe.

Reference to FIGS. 5 and 6, the guiding pipe 50 encloses the connecting section 34 of the cable 30 to transmit the light from the light-emitting component 151 and has two recesses 51 defined on opposite sides of the cable 30. The recess 51 of the guiding pipe 50 is of U shape and opens to the internal printed circuit board 15. The mating plug 10 and the guiding pipe 50 have a space 17 defined therebetween and in communication with the recess 51 for receiving a block member 90. The guiding pipe 50 has a plurality of cavities 521 defined on an edge portion thereof in alignment with the light-emitting component 151. The guiding pipe 50 has a projection 53 exposed out of the outer barrel 70 for visioning the light of the light-emitting component 151. The guiding pipe 50 has a plurality of protrusions 522 disposed thereon for locking with the outer barrel 70.

The mating plug 10 has the tube 35 made from insulative material and enclosing the cable 30 by injection molding. The recess 51 is adapted for receiving the block member 90 to prevent the insulative material from reaching the internal printed circuit board 15 when the tube is injection molded over the cable 30.

Reference to FIGS. 1-6, the method for assembling the power connector 100, comprising the steps of: (1) providing the mating plug 10 having the internal printed circuit board 15 mounted therein and the pair of light-emitting components 151 mounted to the internal printed circuit board 15; (2) providing the cable 30 connecting with the mating plug 10 and having a connecting section 34; (3) providing the guiding pipe 50 encircling the connecting section 34 of the cable 30; (4) inserting the mating plug 10 and the cable 30 into a mold (not shown); (5) providing a block member 90 received into the recess 51 of the guiding pipe 50 and located between the guiding pipe 50 and the internal printed circuit board 15; (6) forming a tube over the cable 30 by injection molding; (7) removing the block member 90 from the recess 51 and the space 17; (8) providing the outer barrel 70 enclosing over the mating plug 10 and the guiding pipe 50.

The recess 51 of the guiding pipe 50 receiving the block member 90 could prevent insulative material from reaching the internal printed circuit board 15 when the tube 35 is injection molded over the guiding pipe 50 and the cable 30 for providing a protection of the internal printed circuit board 15 and the lighting-emitting component 151.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector matable with a complementary connector, comprising:

a mating plug including an internal printed circuit board and a light-emitting component mounted to the internal printed circuit board for indicating working status of the power connector;

a cable connected to the printed circuit board and provided with a connecting section;

a guiding pipe enclosing the connecting section of the cable to transmit the light from the light-emitting component;

a tube made from insulative material and enclosing the cable by injection molding; and said guiding pipe having a recess defined therein to receive a block member to prevent the insulative material from reaching the internal printed circuit board when the tube is injection molded over the cable, wherein said recess of the guiding pipe is of U shape and opens to the internal printed circuit board, wherein the mating plug and the guiding pipe have a space defined therebetween and in communication with the recess of the guiding pipe for receiving the block member.

2. The power connector as claimed in claim 1, wherein said block member is located in a rear part of the recess and between the internal printed circuit board and the guiding pipe.

3. The power connector as claimed in claim 1, wherein said guiding pipe has a plurality of cavities defined on an edge portion thereof in alignment with the light-emitting component.

4. The power connector as claimed in claim 1, further comprising an outer barrel partially enclosing the mating plug and the guiding pipe, the guiding pipe having a plurality of protrusions disposed thereon for locking with the outer barrel.

5. The power connector as claimed in claim 4, wherein said guiding pipe has a projection exposed out of the outer barrel for indicating the light of the light-emitting component.

6. The power connector as claimed in claim 5, wherein said mating plug has a central pin embedded therein, an insulator enclosing the central pin, and a terminal received in the insulator, wherein said cable has one leg extending through the internal printed circuit board to electrically connect with the terminal of the mating plug.

7. A method for assembling a power connector, comprising the steps of:

providing a mating plug having an internal printed circuit board and a light-emitting component mounted to the internal printed circuit board;

providing a cable connected with the mating plug and having a connecting section;

providing a guiding pipe encircling the connecting section of the cable and defining a recess opened to the internal printed circuit board;

inserting the mating plug and the cable into a mold;

providing a block member received into the recess and located between the guiding pipe and the internal printed circuit board;

forming a tube over the cable by injection molding; and removing the block from the guiding pipe, wherein said recess of the guiding pipe is of U shape and opens to the internal printed circuit board, wherein the mating plug and the guiding pipe have a space defined therebetween and in communication with the recess for receiving the block member.

8. A method of assembling the power connector as claimed in claim 7, wherein said block member is located a rear part of the recess and between the internal printed circuit board and the guiding pipe.

9. A method of assembling the power connector as claimed in claim 7, wherein said guiding pipe has a plurality of cavities defined on an edge portion thereof in alignment with the light-emitting component.

10. A method of assembling the power connector as claimed in claim 7, further providing an outer barrel partially enclosing the mating plug and the tube.

11. A method of assembling the power connector as claimed in claim 10, wherein said guiding pipe has a projection exposed out of the outer barrel for indicating the light of the light-emitting component.

12. A method of assembling the power connector as claimed in claim 7, wherein said mating plug has a central pin embedded therein, and a terminal located adjacent to the internal printed circuit board of the mating plug, wherein said the cable extending through the internal printed circuit board to electrically connect with the terminal of the mating plug.

13. A power connector matable with a complementary connector comprising:

a mating plug including mating port and an internal printed circuit board located behind the mating port, a light-emitting component mounted to the internal printed circuit board for indicating working status of the power connector;

a plurality of contacts associated with the housing;

a cable behind the printed circuit board and provided with a connecting section;

a tubular light guiding pipe enclosing the connecting section of the cable to transmit the light from the light-emitting component; and a protective sleeve made from insulative material and enclosing the cable by injection molding and located behind the light guiding pipe; wherein said guiding pipe having a recess therein to transversely communicate with an exterior so as to allow a block member to be inserted into an interior of the guiding pipe to blocking the printed circuit board for preventing the insulative material from contaminating the internal printed circuit board when the protective sleeve is injection molded over the cable, wherein said printed circuit board is vertically positioned relative to an axial direction of the cable, wherein said printed circuit board includes a through notch or a through hole to allow one of the contact and the cable to extend therethrough to reach the other for electrical connection therebetween.

* * * * *